US011508540B2

(12) United States Patent
Adami et al.

(10) Patent No.: US 11,508,540 B2
(45) Date of Patent: Nov. 22, 2022

(54) CIRCUIT BREAKER

(71) Applicant: ABB S.p.A., Milan (IT)

(72) Inventors: Alessandro Adami, Bergamo (IT); Luigi Arturo Degli Innocenti, Bergamo (IT)

(73) Assignee: ABB S.p.A., Milan (IT)

( * ) Notice: Subject to any disclaimer, the term of this patent is extended or adjusted under 35 U.S.C. 154(b) by 131 days.

(21) Appl. No.: 17/050,020

(22) PCT Filed: Apr. 17, 2019

(86) PCT No.: PCT/EP2019/059934
§ 371 (c)(1),
(2) Date: Oct. 23, 2020

(87) PCT Pub. No.: WO2019/206765
PCT Pub. Date: Oct. 31, 2019

(65) Prior Publication Data

US 2021/0098219 A1 Apr. 1, 2021

(30) Foreign Application Priority Data

Apr. 23, 2018 (EP) ..... 18168681

(51) Int. Cl.
*H01H 50/54* (2006.01)
*H01H 71/10* (2006.01)
(Continued)

(52) U.S. Cl.
CPC ..... *H01H 71/1009* (2013.01); *H01H 71/04* (2013.01); *H01H 71/52* (2013.01)

(58) Field of Classification Search
CPC .... H01H 71/1009; H01H 71/04; H01H 71/52; H01H 2205/002; H01H 71/1045;
(Continued)

(56) References Cited

U.S. PATENT DOCUMENTS 825,144 A * 7/1906 Mayer ..... H01H 71/1009 335/10
2,348,996 A * 5/1944 Parkhurst ..... H01H 71/52 337/69

(Continued)

FOREIGN PATENT DOCUMENTS

WO 8808614 A1 11/1998
WO 03012812 A1 2/2003
WO 2014167603 A1 10/2014

OTHER PUBLICATIONS

European Patent Office, International Search Report & Written Opinion issued in corresponding Application No. PCT/EP2019/059934, dated August 7, 2019, 13 pp.

(Continued)

*Primary Examiner* — Bernard Rojas
*Assistant Examiner* — Lisa N Homza
(74) *Attorney, Agent, or Firm* — Armstrong Teasdale LLP

(57) ABSTRACT

A circuit breaker includes a first fixed contact and a first movable contact which can be switched between a closed status and a tripped status, a signaling device for signaling when the circuit breaker is in a tripped status, a trip actuator movable from an initial position to an end-stroke position when the first movable contact is switched from the closed status to the tripped status, a tripping bar which is connected to the first movable contact so as when the trip actuator moves from the initial position, the tripping bar moves and triggers switching of the first movable contact from the closed status into the tripped status, and a trip member having a single-piece shaped body, which includes a first portion actuated by the trip actuator, a second portion spaced apart from the first portion, and a third portion spaced apart from the first and second portions.

19 Claims, 17 Drawing Sheets

(51) Int. Cl.
*H01H 71/04* (2006.01)
*H01H 71/52* (2006.01)

(58) Field of Classification Search
CPC ..... H01H 71/12; H01H 71/02; H01H 71/164; H01H 71/0271; H01H 71/2436; H01H 71/405; H01H 71/325; H01H 2071/168
USPC ..... 335/2
See application file for complete search history.

(56) References Cited

U.S. PATENT DOCUMENTS 2,662,949 A * 12/1953 Christensen ..... H01H 71/1009 337/67
2,662,950 A * 12/1953 Christensen ..... H01H 71/52 337/55
2,686,242 A * 8/1954 Leonard ..... H01H 71/04 337/72
2,690,486 A * 9/1954 Wilckens ..... H01H 71/1009 335/10
2,876,308 A * 3/1959 Christensen ..... H01H 71/1009 335/37
2,923,795 A * 2/1960 Martin ..... H01H 71/529 337/46
3,142,732 A * 7/1964 Clarke ..... H01H 73/30 337/45
3,171,928 A * 3/1965 Powell ..... H01H 71/52 200/560
3,183,325 A * 5/1965 Norden ..... H01H 73/60 337/79
3,213,248 A * 10/1965 Leonard ..... H01H 71/162 337/72
3,365,682 A * 1/1968 Fujita ..... H01H 73/60 335/23
3,421,129 A * 1/1969 Brackett, Sr. ..... H01H 71/58 335/22
3,815,058 A * 6/1974 Stetsuk ..... H01H 71/1009 335/8
3,956,721 A * 5/1976 Link ..... H01H 33/666 218/139
4,077,024 A * 2/1978 Lisnay ..... H01H 71/1009 335/10
4,118,608 A * 10/1978 Kussy ..... H01H 71/04 200/50.05
4,968,863 A * 11/1990 Rezac ..... H01H 71/0214 335/35
5,041,805 A * 8/1991 Ohishi ..... H01H 89/08 335/14
5,075,657 A * 12/1991 Rezac ..... H01H 71/526 335/21
5,164,693 A * 11/1992 Yokoyama ..... H01H 89/10 335/14
5,200,725 A * 4/1993 Arnold ..... H01H 71/1009 335/10
5,214,402 A * 5/1993 DiVincenzo ..... H01H 71/1027 335/23
5,241,290 A * 8/1993 Sehmer ..... H01H 71/56 335/185
5,258,733 A * 11/1993 Link ..... H01H 71/2472 335/172
5,260,676 A * 11/1993 Patel ..... H01H 71/1009 335/132
5,262,744 A * 11/1993 Arnold ..... H01H 71/1009 335/8
6,080,947 A * 6/2000 Ulerich ..... H01H 71/04 200/400
6,172,584 B1 * 1/2001 Castonguay ..... H01H 83/20 335/172
6,188,302 B1 * 2/2001 Conway ..... H01H 71/465 335/172
6,194,983 B1 * 2/2001 Bogdon ..... H01H 71/56 335/73
6,259,339 B1 * 7/2001 Simms ..... H01H 89/06 335/14
6,400,242 B1 * 6/2002 Fasano ..... H01H 71/465 200/18
6,614,334 B1 * 9/2003 Gibson ..... H01H 71/1045 335/132
6,639,492 B1 * 10/2003 Hall ..... H01H 71/04 200/334
6,788,172 B1 * 9/2004 Godesa ..... H01H 3/30 335/17
9,343,256 B1 5/2016 Gibson
10,510,506 B1 * 12/2019 Fasano ..... H01H 83/226
2002/0158726 A1 * 10/2002 Wellner ..... H01H 71/04 335/18
2002/0175786 A1 * 11/2002 Wellner ..... H01H 71/02 335/16
2003/0210114 A1 * 11/2003 Brandon ..... H01H 71/524 335/21
2004/0149555 A1 * 8/2004 Jordan ..... H01H 71/1009 200/400
2004/0239458 A1 * 12/2004 Harmon ..... H01H 77/02 335/201
2005/0046526 A1 * 3/2005 Lipsey, II ..... H01H 73/14 335/17
2006/0071742 A1 * 4/2006 Castonguay ..... H01H 89/08 335/20
2008/0042787 A1 * 2/2008 McCoy ..... H01H 71/04 335/186
2009/0014300 A1 * 1/2009 Ahn ..... H01H 71/04 335/17
2010/0264001 A1 * 10/2010 Spitsberg ..... H01H 71/04 200/308
2010/0288606 A1 * 11/2010 Rival ..... H01H 1/0015 200/260
2011/0214975 A1 * 9/2011 Gottschalk ..... H01H 71/04 340/653
2013/0126316 A1 * 5/2013 Woodson ..... H01H 71/1009 200/81.9 R
2013/0134982 A1 * 5/2013 Cazals ..... G01D 5/04 324/415
2014/0034466 A1 * 2/2014 Warne ..... H01H 71/04 200/308
2014/0103013 A1 * 4/2014 Chen ..... H01H 77/02 218/147
2016/0005555 A1 * 1/2016 Najera ..... H01H 71/2454 335/43
2016/0181045 A1 * 6/2016 Gates ..... H01H 71/522 200/330
2016/0300682 A1 * 10/2016 Fasano ..... H01H 71/2463
2017/0098520 A1 * 4/2017 Mittelstadt ..... H01H 71/04
2017/0194123 A1 * 7/2017 Tetik ..... H01H 71/04
2017/0271106 A1 * 9/2017 Dumont ..... H01H 21/36
2020/0027678 A1 * 1/2020 Gibson ..... H01H 71/02
2020/0203108 A1 * 6/2020 Mittelstadt ..... H01H 71/12
2021/0005413 A1 * 1/2021 Gottschalk ..... H01H 71/58
2021/0005415 A1 * 1/2021 Gottschalk ..... H01H 71/10
2021/0193404 A1 * 6/2021 Court ..... H01H 5/06

OTHER PUBLICATIONS

European Patent Office, Extended Search Report issued in corresponding Application No. 18168681.7, dated Aug. 8, 2018, 7 pp.

* cited by examiner

CIRCUIT BREAKER

BACKGROUND

The present disclosure relates to a circuit breaker having an improved constructive structure, and in particular a simplified tripping mechanism.

As known, low-voltage electrical circuits, e.g. for applications having rated voltages lower than 1 kV AC and 1.5 kV DC, normally use specific devices commonly referred to in the art as automatic power circuit breakers or similar definitions.

These circuit breakers are designed to provide a series of functional performances required to ensure the correct operation of the electrical system in which they are inserted and of the loads connected to it; for example, they ensure the nominal current required for the various users, allow correct insertion and disconnection of the loads with respect to the circuit, protect the loads against abnormal events such as overloading and short-circuits by opening the circuit automatically.

To perform these tasks, circuit breakers comprise one or more electric poles intended to be electrically connected to corresponding conductors of the electric line in which they are inserted, and each electric pole comprises one or more movable contacts and one or more associated fixed contacts that can be mutually coupled/uncoupled; suitable control and actuating mechanisms are provided in order to reversibly move the mobile contacts of each pole from a coupling position to an uncoupling position with the corresponding fixed contacts, thus changing the operative status of the circuit breaker.

More in particular, a circuit breaker can basically assume three different operative states, namely a circuit breaker closed status where each movable contact is electrically coupled with a corresponding fixed contact, a circuit breaker open status or a circuit breaker tripped status where instead each movable contact is electrically separated from the corresponding fixed contact.

Typically, switching between the closed status and the open status or vice-versa is obtained by action of a user or of an actuator (e.g. a MOE—Motor Operated Actuator) on an external handle of the circuit breaker itself.

When there is an abnormal electrical condition, such as a short circuit, suitable control means and associated tripping mechanism cause separation of each movable contact from the corresponding fixed contact, thus switching the circuit breaker from the closed status to the so-called tripped status. In this position, when possible, the reverse switching from the tripped status to the closed status is usually obtained by intervening on the external handle, thus resetting the entire mechanism of the circuit breaker.

In addition, according to relevant standards, known circuit breakers are provided with suitable signaling devices which must be actuated in order to signal when the circuit breaker has switched into a tripped status.

Currently, mechanisms adapted to actuate the movable contacts are available according to numerous industrial solutions, and basically comprise an actuator which is released from a rest position and initiate actuation of the entire mechanism, a trip shaft which is actuated following the movement of the initiating actuator from the rest position, and a plurality of components, such as levers, spring, et cetera, which are adapted to transmit movement from the initiating actuator to the trip shaft and from this to the movable contacts; some components are also dedicated to actuate the mentioned signaling device in case of a tripping maneuver.

Although known solutions properly perform the required functionalities, there is still need and space for further improvements, in particular as regard to the number of components of the actuating mechanism and related constructive, mounting and functional complexity.

BRIEF DESCRIPTION

Thus, the present disclosure is aimed at facing such issues and in particular at providing a circuit breaker where the mechanism aimed at realizing tripping operations is realized according to a simplified solution over prior art known mechanisms.

This aim is fulfilled by a circuit breaker comprising:

- at least a first fixed contact and a first movable contact which can be switched between at least a circuit breaker closed status where the fixed and movable contacts are coupled to each other, and a circuit breaker tripped status where the fixed and movable contacts are separated from each other;
- a signaling device suitable to be actuated in order to signal when the circuit breaker is in a tripped status;
- a trip actuator suitable to move from an initial position to an end-stroke position when said at least first movable contact has to be switched from said circuit breaker closed status into said circuit breaker tripped status;
- a tripping bar which is operatively connected to said first movable contact so as when said trip actuator moves from said initial position, said tripping bar moves from an un-tripped position towards a tripped position to trigger switching of said first movable contact from said circuit breaker closed status into said circuit breaker tripped status; characterized in that it further comprises a trip member movable between a rest position and an actuated position, said trip member having a single-piece shaped body which comprises a first portion suitable to interact with and be actuated by said trip actuator to move from said rest position towards said actuated position when the trip actuator moves from said initial position towards said end-stroke position, a second portion which is spaced apart from said first portion and is suitable to interact and actuate said tripping bar to move from said un-tripped position towards said tripped position, and a third portion which is spaced apart from said first and second portions and is suitable to interact with and actuate said signaling device.

BRIEF DESCRIPTION OF THE DRAWINGS

Further characteristics and advantages will become more apparent from the description of some preferred but not exclusive embodiments of the circuit breaker according to the disclosure, illustrated only by way of non-limiting examples with the aid of the accompanying drawings, wherein.

DETAILED DESCRIPTION

Figure 1:
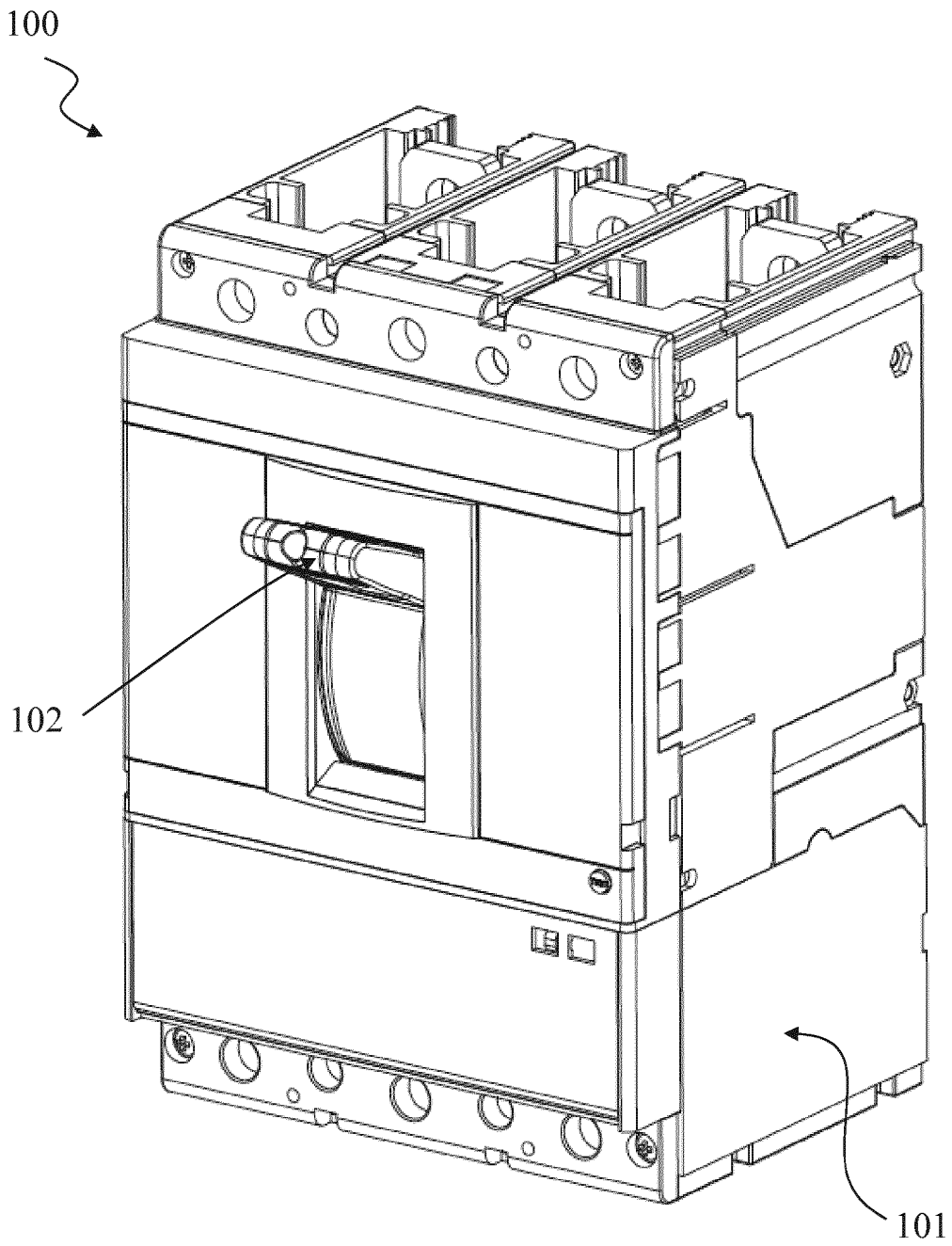
FIG. 1 is a perspective view illustrating an exemplary circuit breaker according to the present disclosure.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not necessarily be to scale and certain features of the disclosure may be shown in somewhat schematic form.

Further, when the term "adapted" or "arranged" or "configured" or "shaped", is used herein while referring to any component as a whole, or to any part of a component, or to a whole combinations of components, or even to any part of a combination of components, it has to be understood that it means and encompasses correspondingly either the structure, and/or configuration and/or form and/or positioning of the related component or part thereof, or combinations of components or part thereof, such term refers to.

Finally, if the term transversal or transversally is hereinafter used, it encompasses a direction non-parallel to the element or direction is related to, and perpendicularity has to be considered a specific case of transverse direction.

An exemplary embodiment of a circuit breaker according to the present disclosure is indicated in FIG. 1 with the overall reference number 100; in particular, the exemplary circuit breaker illustrated in FIG. 1 is a low voltage Molded Case Circuit Breaker (MCCB), without intending in any way to limit the application of the present disclosure to other suitable types of circuit breakers.

The illustrated circuit breaker 100 comprises a casing 101 and a handle 102 which protrudes outside from the casing 101 and is suitable for example to allow a user to manually switch the circuit breaker from a closed status to an open status or vice-versa, and to reset the circuit breaker and bring it back from a tripped status into the closed one as it will become apparent from the following description.

Figure 15:
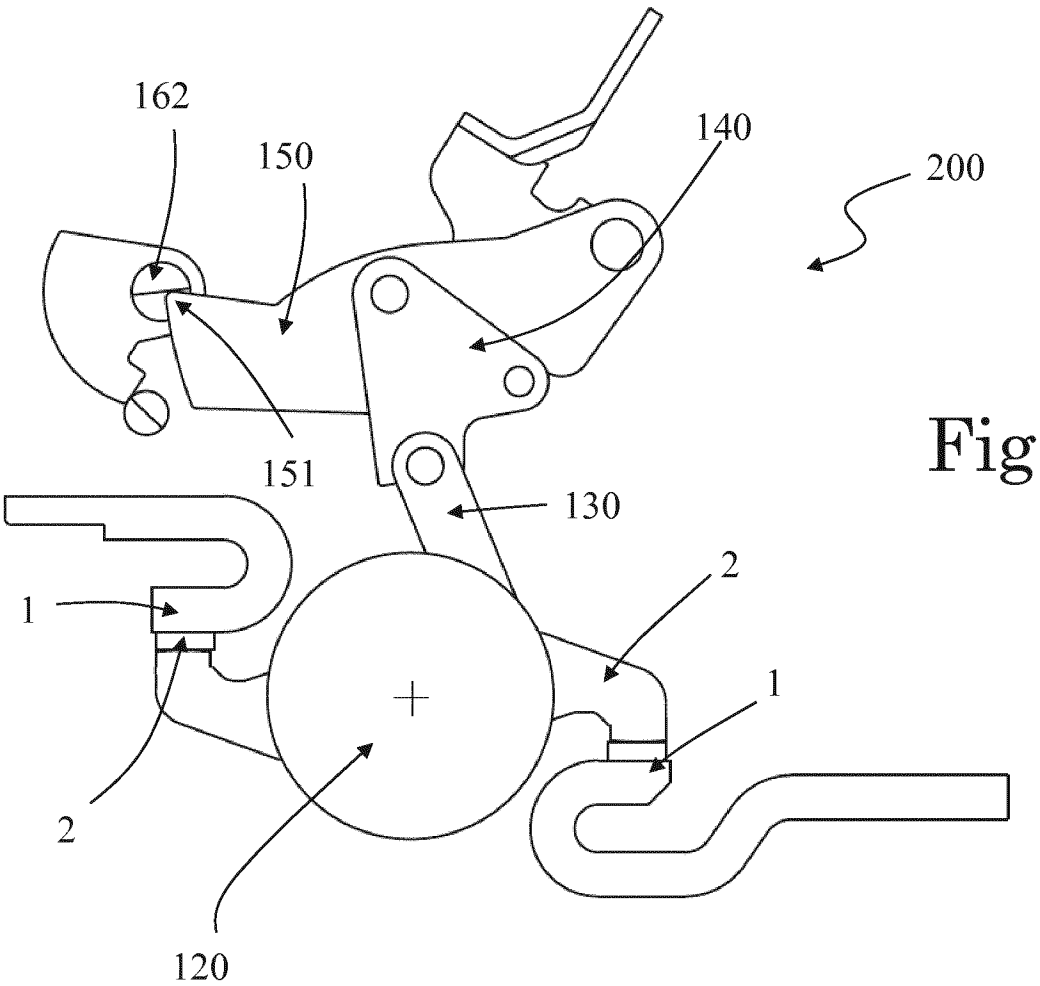
FIG. 15 is a schematic view showing an exemplary assembly contacts-actuating means usable in a circuit breaker according to the present disclosure, with the circuit breaker in a closed status.
Figure 16:
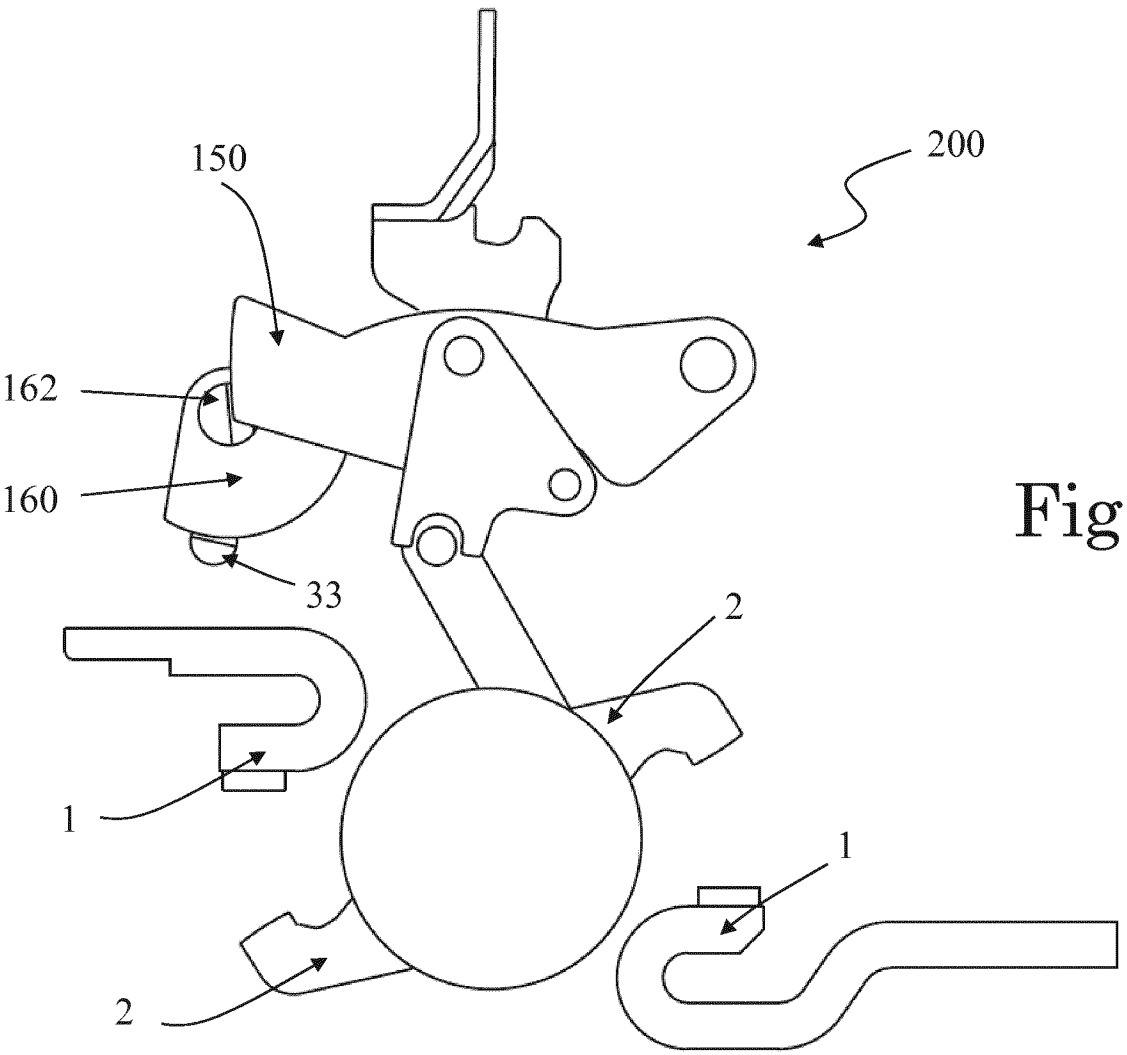
FIG. 16 shows the assembly of FIG. 15 switched into a circuit breaker tripped status.
Figure 17:
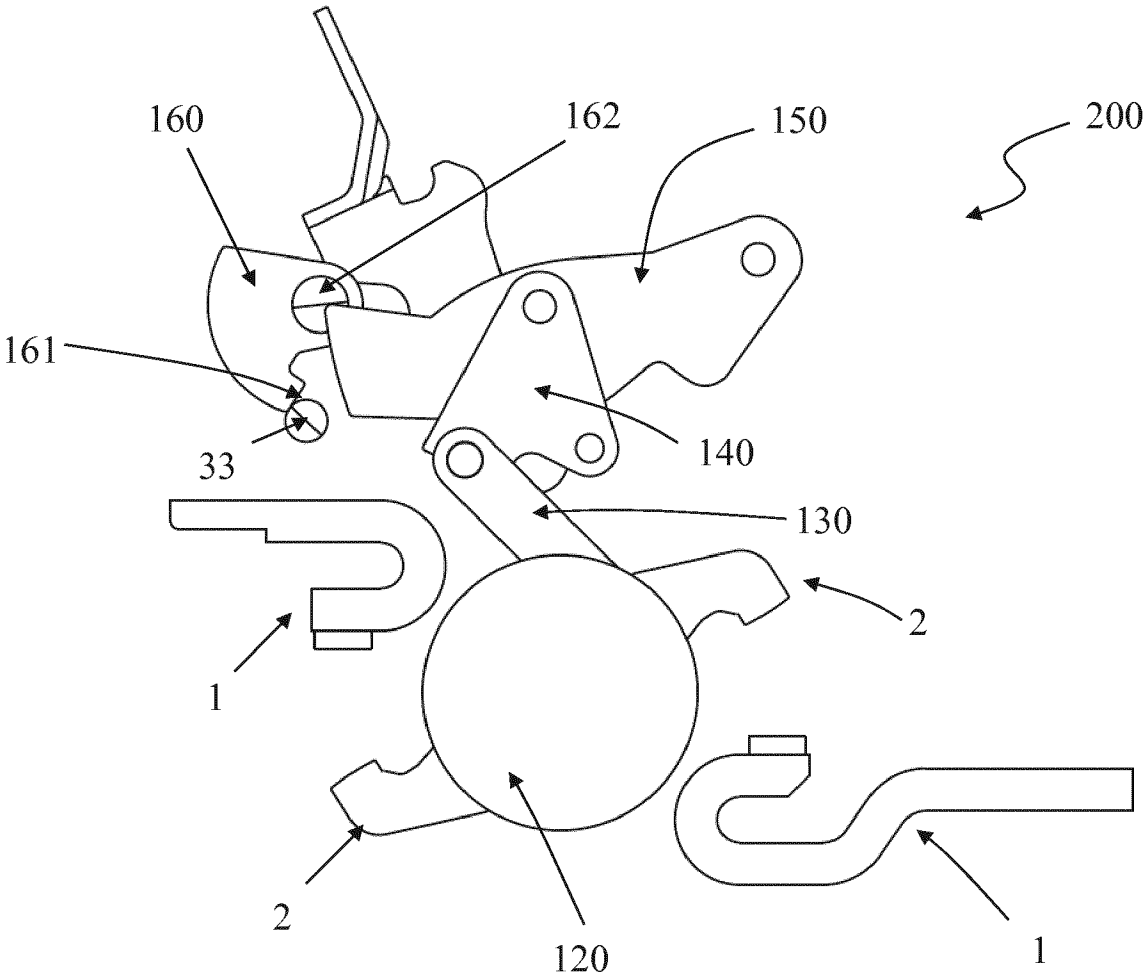
FIG. 17 shows the assembly of FIG. 15 switched into a circuit breaker open status.

Inside the casing 101 there are provided, for each phase or pole, at least a first fixed contact 1 and an associated first movable contact 2, illustrated in FIGS. 15-17.

Clearly, depending on the applications, the circuit breaker 100 can comprise any suitable number of poles, e.g. three as illustrated in the example of FIG. 1; further, in the exemplary and non limiting examples illustrated in the attached figures, the circuit breaker 100 is of double-contact type, namely for each phase or pole there are two fixed contacts 1 and two corresponding movable contacts 1.

In operations the movable contact(s) 2 of the various poles are actuated to move between at least a circuit breaker closed status where the fixed and corresponding movable contacts 1, 2 are coupled to each other, as illustrated in FIG. 15, and a circuit breaker tripped status where the fixed and corresponding movable contacts 1, 2 are separated from each other, as illustrated in FIG. 16.

As indicated, such switching operations bringing the circuit breaker into the so-called tripped status usually occur in presence of detected electrical faults, such as a short circuit.

In addition, starting from the circuit breaker closed status, the movable contact(s) 2 of the various poles can be actuated to separate from the corresponding fixed contacts 1 in order to switch into a circuit breaker open position, illustrated for instance in FIG. 17. Such switching operations can be executed for instance by a user or a motorized actuator, acting on the handle 102.

In some cases, during opening it is possible also to cause tripping; further the position of the movable contacts 2 in the open position and in the tripped position can coincide in some cases.

In order to perform such switching operations, the movable contacts 2 are coupled to an actuating mechanism which is schematically indicated in FIGS. 15-17 by the overall reference number 200; the actuating mechanism 200 is per se not relevant for the scope of the present disclosure and can be realized according to several variants and configurations, according to solutions well known in the art or readily available to those skilled in the art and therefore not described herein in details.

For instance, as schematically illustrated in the exemplary and non-limiting embodiment of FIGS. 15-17, an actuating mechanism 200 can comprise, inter alia, a rotating contact-holding-shaft 120 on which the movable contacts 2 are for example mounted on, a first link rod 130 coupled to the shaft 120, a second suitably shaped link rod 140 mechanically connected to the link rod 130 and to a second lever 150, and a further transmission lever 160, e.g. with a circular-sector having a rectangular portion 161, on which there is defined for example a protrusion 162, e.g. ratchet-shaped, suitable to engage/disengage with a corresponding portion 151 of the lever 150, as visible for example in FIG. 15; a drive or command unit also known per se, operatively connected to the mechanism 200, comprising for instance one or more springs, supplies the energy required to actuate the mechanism 200 and hence cause switching of the movable contacts 2 from one position to another.

The circuit breaker 100 according to the disclosure comprises a signaling device 10 which is for example mounted inside the casing 101 and is suitable to be actuated in order to signal when the circuit breaker 100 has reached a tripped status; in the example illustrated, the signaling device 10 comprises for instance a movable lever 11 which is actuated in order to switch the signaling device 10 from a non-signaling state into a signaling state.

Figure 2:
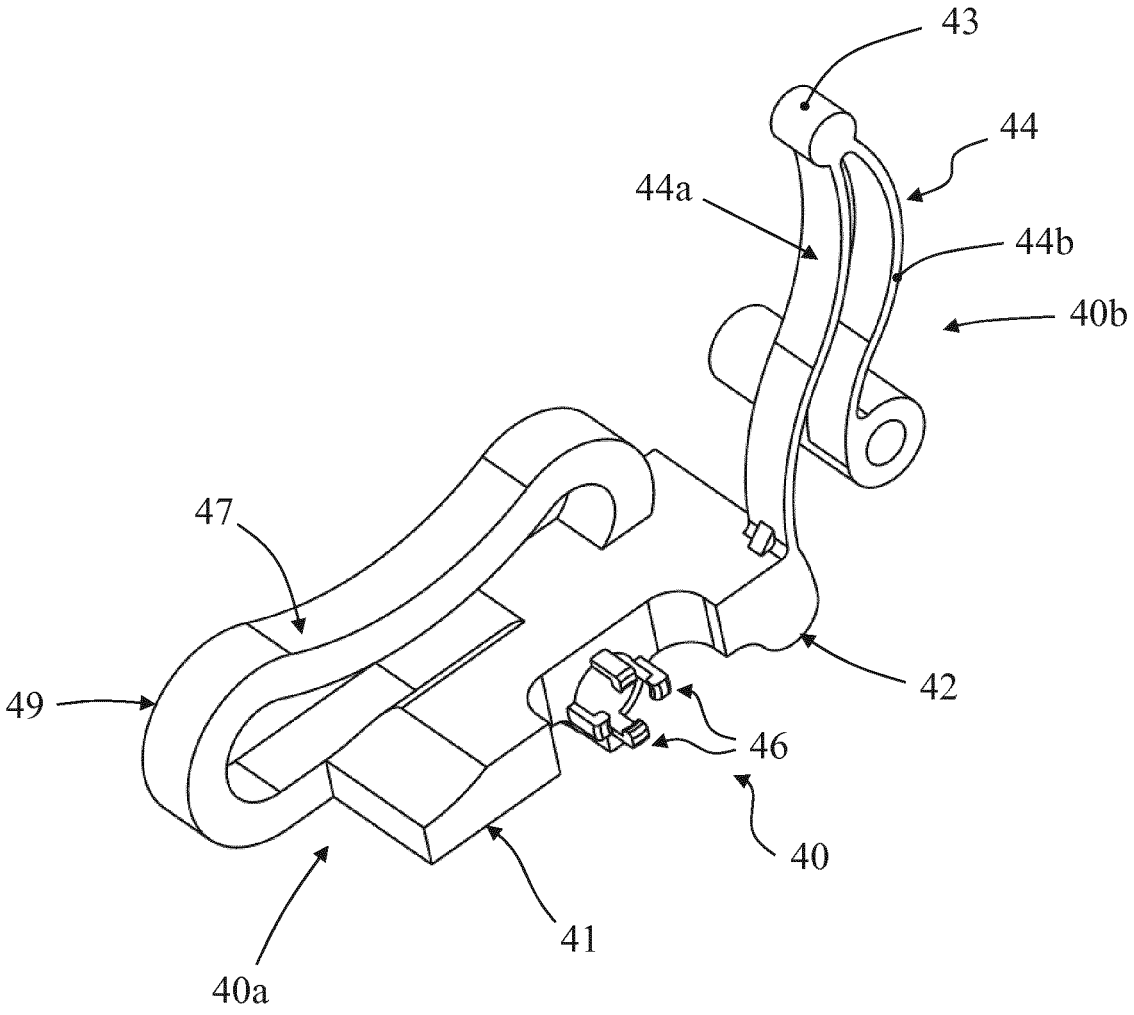
FIG. 2 is a perspective view of a movable single-piece trip member used in a circuit breaker according to present disclosure.
Figure 4:
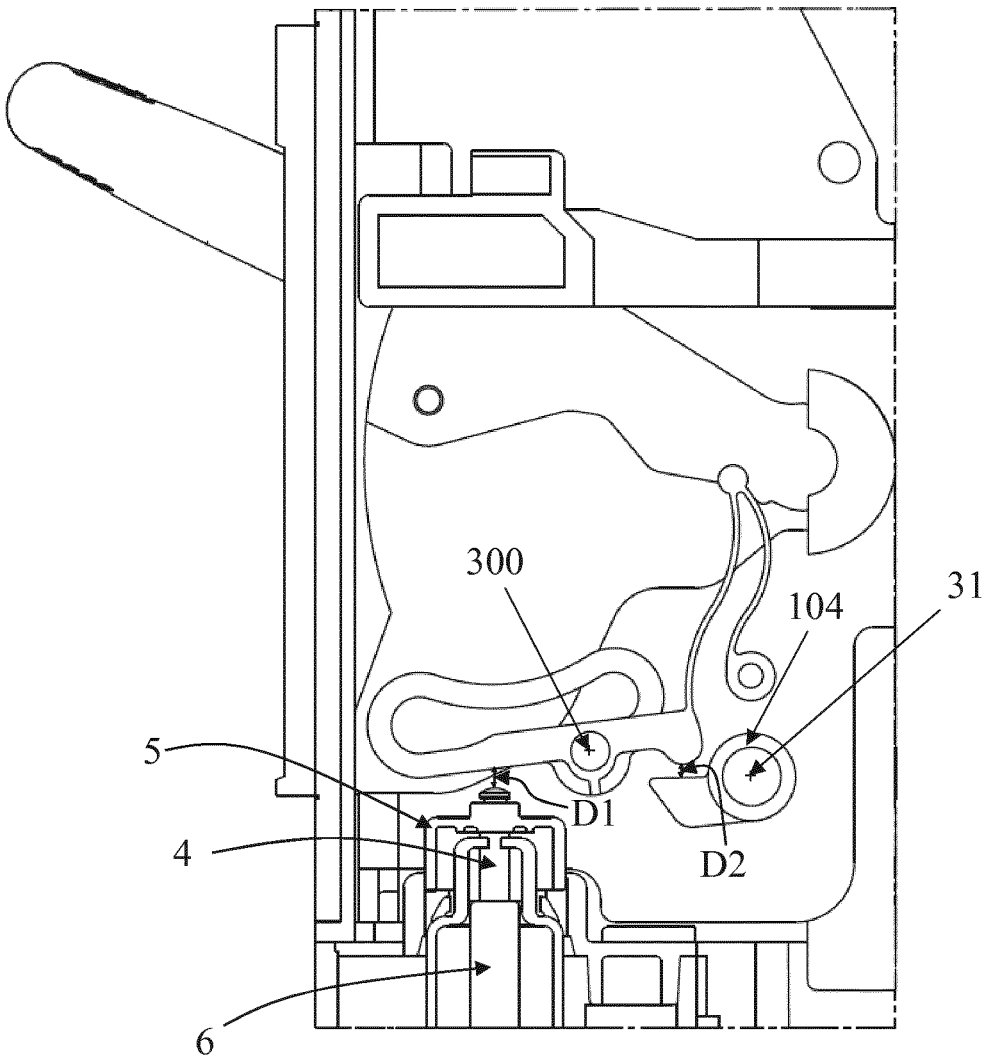
FIG. 4 shows a more detailed view of some components of FIG. 3.
Figure 7:
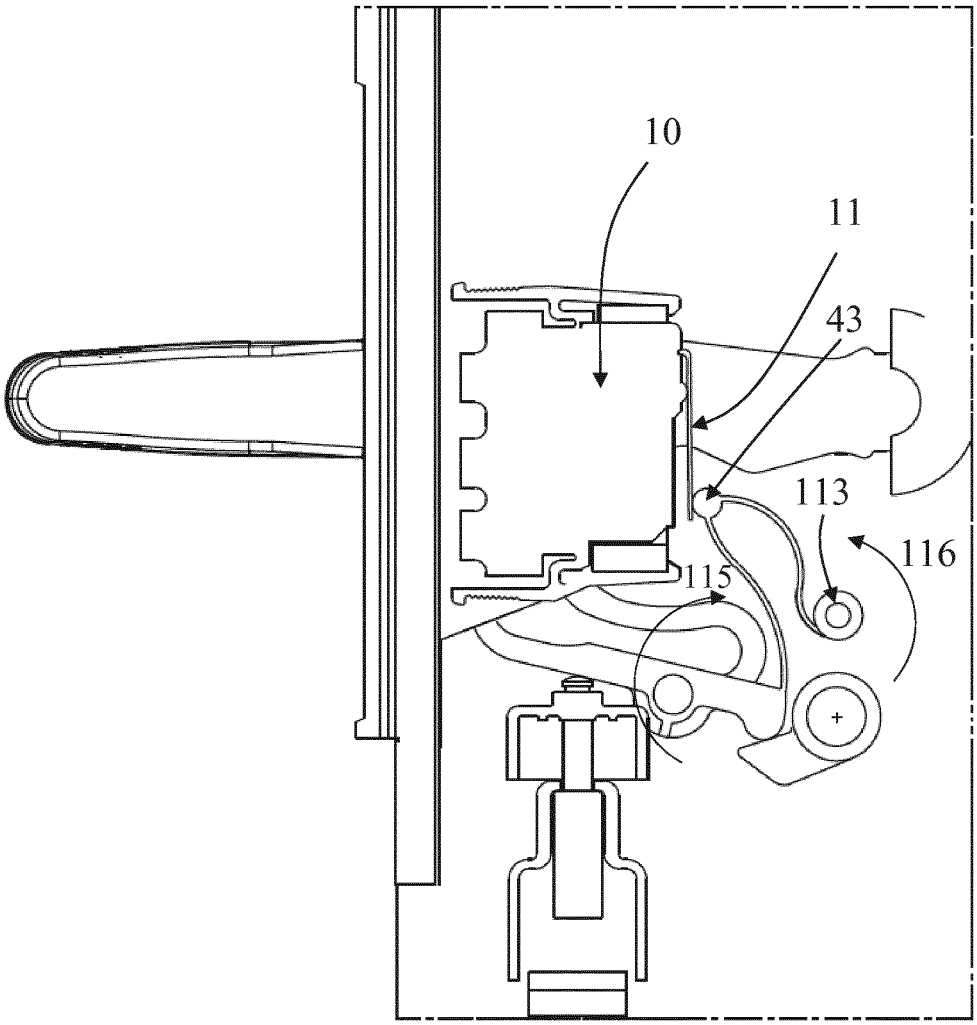

As illustrated, the circuit breaker 100 according to the present disclosure further comprises: a trip actuator 3 suitable to move from an initial position, illustrated for example in FIG. 4, to an end-stroke position, illustrated for example in FIG. 7, when the at least first movable contact 2 has to be switched from a circuit breaker closed status into a circuit breaker tripped status during a tripping operation; a tripping bar 30 which is operatively connected to the first movable contact 2 so as when the trip actuator 3 moves from the initial position towards the end-stroke position, the tripping bar 30 moves from an un-tripped position, illustrated in FIGS. 4 and 15, to a tripped position, illustrated in FIGS. 7 and 16, and triggers switching of the first movable contact(s) 2 from the circuit breaker closed status into a circuit breaker tripped status; and a trip member 40, illustrated in FIG. 2, which is operatively connected to the trip actuator 3 and the tripping bar 30, and is movable between a rest position, illustrated for example in FIG. 4, and an actuated position, illustrated for example in FIG. 7.

In the example illustrated the actuator 3 comprises for instance a plunger 4 movable within a mounting frame 5, a ferro-magnetic core 6, and a spring (not visible in figure) operatively associated to the plunger 4.

In turn, the tripping bar 30 is for example mounted inside the casing 101 on an associated pivot 104 pivotally around a rotation axis 31 and comprises a first protuberance 32 suitable to interact with the trip member 40, and a second shaped protuberance 33, suitable to interact with an associated portion of the actuating mechanism 200 in order to keep the mechanism 200 itself in the position reached when the circuit breaker is in the closed status with the movable contact(s) 2 coupled with the fixed contact(s) 1; in the example illustrated, the shaped protuberance 33 bears against an associated portion 161 of the lever 160, as visible for example in FIG. 15.

Advantageously, in the circuit breaker 100 according to the present disclosure, the trip member 40 has a single-piece shaped body which comprises: a first portion 41 suitable to interact with and be actuated by the trip actuator 3 to move from the rest position towards the actuated position when the trip actuator 3 moves from its initial position towards the end-stroke position; a second portion 42 which is spaced apart from said first portion 41 and is suitable to interact with and actuate the tripping bar 30 to move from said un-tripped position towards said tripped position; and a third portion 43 which is spaced apart from the first and second portions 41, 42 and is suitable to interact with and actuate the signaling device 10.

In particular, the first, second and third portions 41, 42, 43 are spaced apart from each other on the single-piece shaped body of the trip member 30 so as after the actuator 3 has impacted against the first portion 41 and the trip member 40 starts moving from the rest position towards the actuated position, the second portion 42 interacts and actuates the tripping bar 30, and after, while continuing movement, the third portion 43 finally interacts with and actuates the signaling device 10, e.g. actuating the lever 11.

Preferably, the movable trip member 40 comprises at least one portion 44 and/or 47 which is elastically deformable with respect to the remaining part of the shaped body when the trip member moves from the rest position to the actuated position (or viceversa).

Preferably, the movable trip member 40 comprises at least one mounting seat 45 and/or 51 which is pivotally mounted around an associated pivot 112 and/or 113 provided inside the circuit breaker 100.

Advantageously, the movable trip member 40 comprises at least first retaining means 46 which are structurally integral with the single-piece shaped body and mechanically retain the movable trip member 40 coupled to the associated pivot 112 and/or 113; preferably, the retaining means are provided at least at said at least one mounting seat 45 and/or 51.

As illustrated, the shaped body of the movable trip member 40 comprises a first part **40*a* on which there are provided the first and second portions 41, 42, and a second part 40*b* on which there is provided the third portion 43, e.g. at the tip thereof, and is structured in such a way that the first part 40*a* and the second part 40*b* move in opposite directions with respect to each other when the movable trip member 40** is actuated to move from the rest position towards the actuated position.

In particular, in the exemplary embodiments illustrated, the movable trip member 40 comprises a first mounting seat 45 realized for instance as a through channel 45, e.g. a sleeve, which is provided on the first part **40*a* and is pivotally mounted around a first pivot 112 provided inside the circuit breaker; in this way, and thanks to the overall structure of the single-piece shaped body, the first part 40*a* rotates around a rotation axis 300 of the first pivot 112 when the trip member 40** moves from the rest position towards the actuated position, and remains still in the rest position without the aid of any other element, such as ad-hoc retaining springs.

In the rest position, the first portion 41 is at a predefined distance D1 from the trip actuator 3, and in particular from the head surface of the plunger meant to impact against the first portion 41; in turn, the second portion 42 is at a predefined distance D2 from the tripping bar 30, and in particular from the surface of its protuberance 32 where the second portion 42 impacts against.

According to the exemplary embodiments illustrated in FIGS. 2-12, the movable trip member 40 comprises a second mounting seat 51, e.g. also realized for instance as a second through channel 51 which is pivotally mounted around a second pivot 113 provided inside the circuit breaker.

In the exemplary embodiments illustrated in FIGS. 2-10 and 12, the through channel 51 has a circular cross-section, likewise the first through channel 45, hence forming a sleeve.

Figure 11:
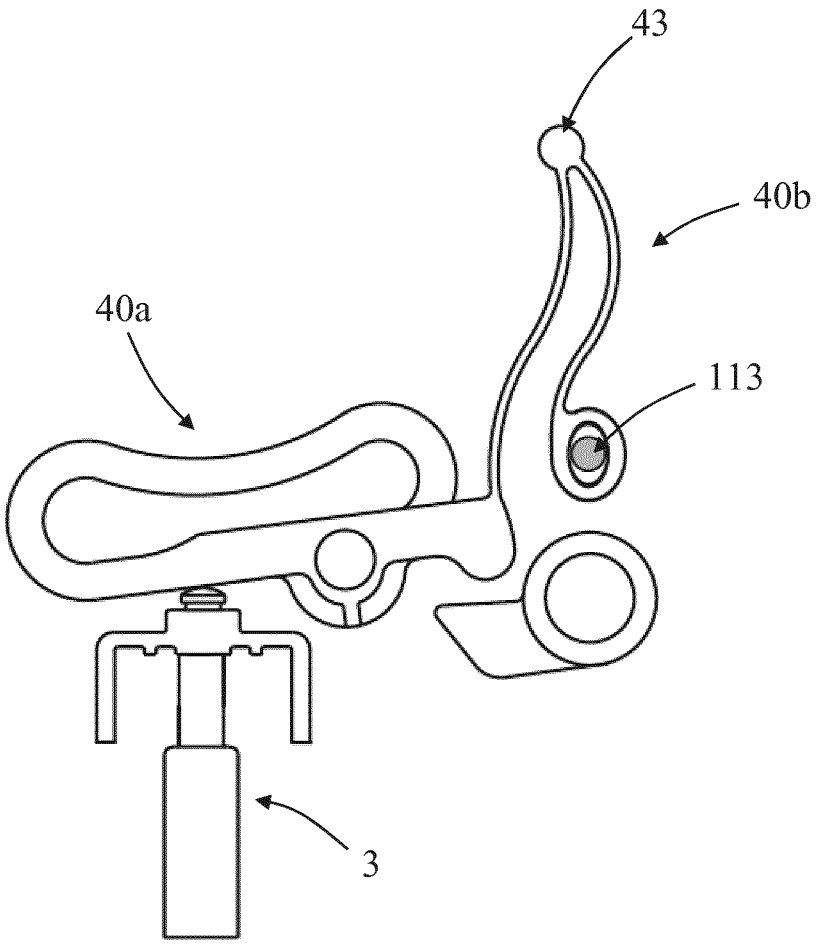
FIGS. 11-14 are schematic side views showing some exemplary embodiments which can be used in a circuit breaker according to the disclosure.
Figure 12:
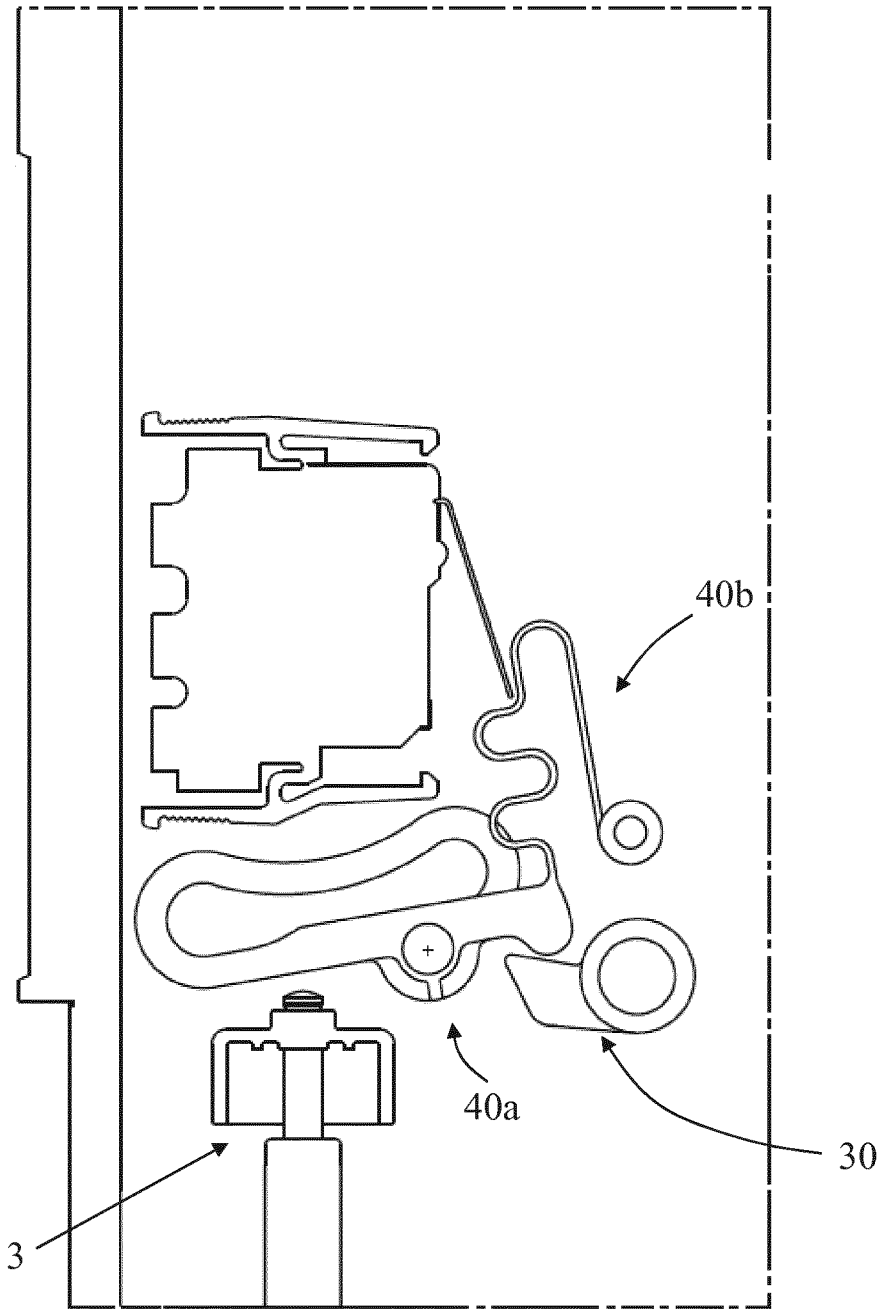

In the embodiment of FIG. 11 instead, the second through channel 51 has preferably a slot, i.e. elliptic, cross-section; according to this embodiment, when the first part **40*a* of the movable trip member 40 starts rotating around the first pivot 112, the second pivot 113 for a short initial time slides inside the second though channel 51 before the second part 40*b* starts rotating around the second pivot 113, and thus before deformation of the portion 44*a*** starts to occur.

Figure 13:
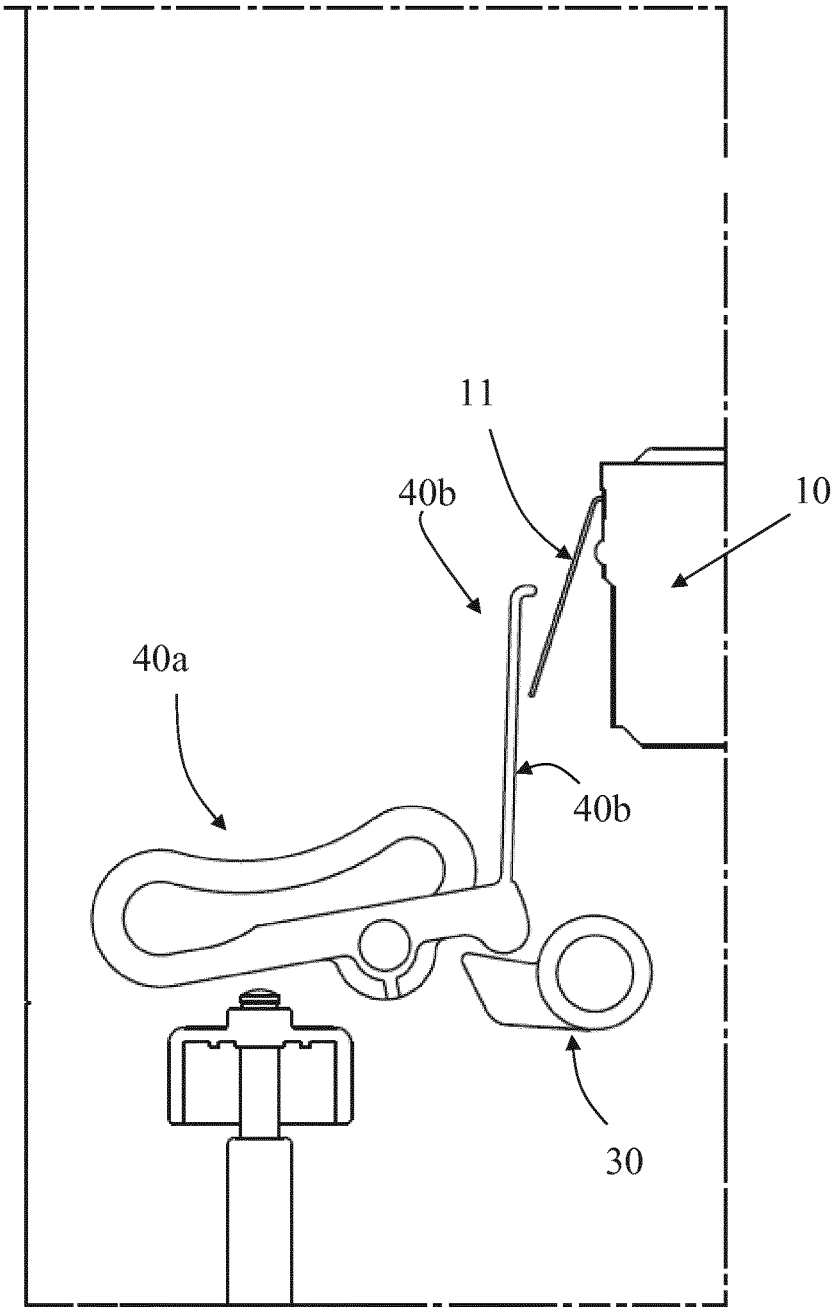
Figure 14:
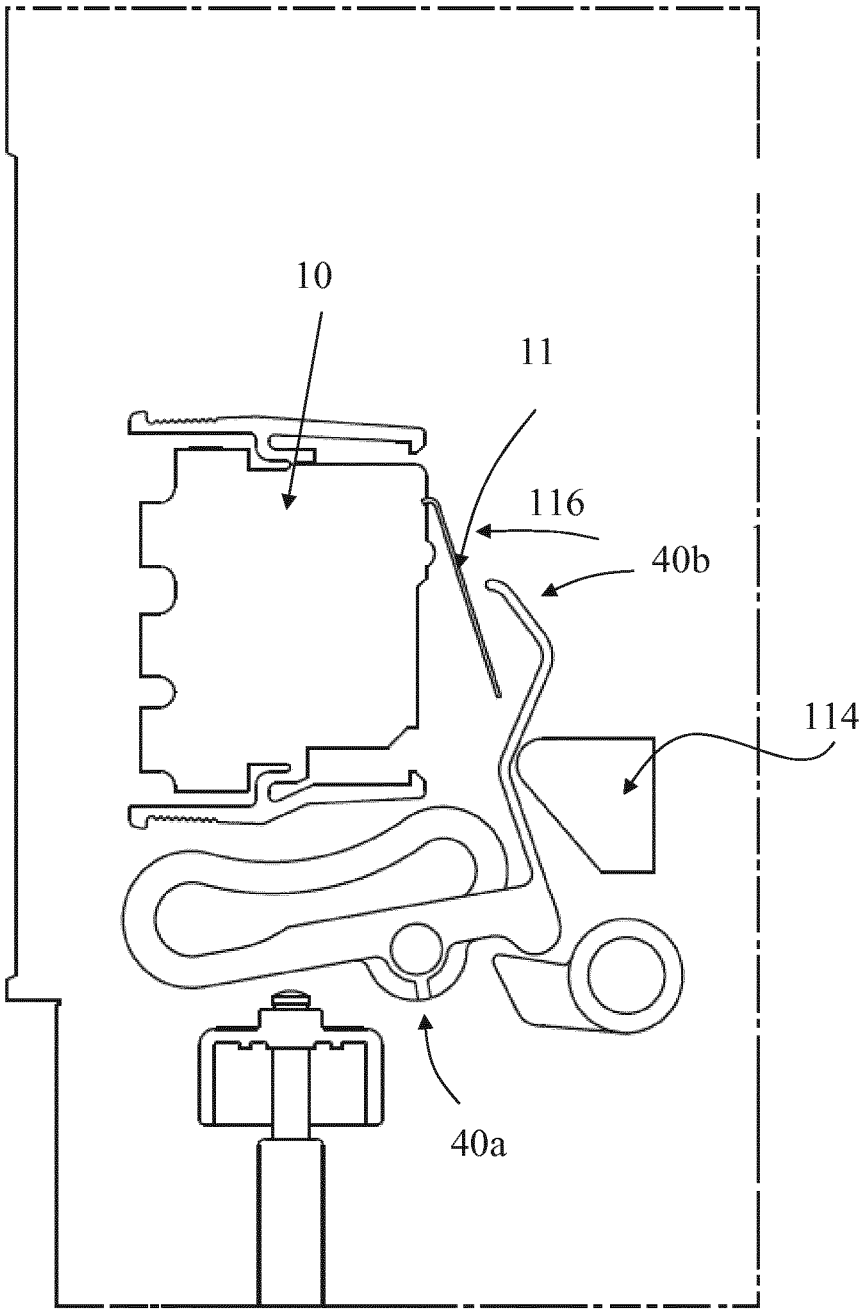

In the exemplary embodiments illustrated in FIGS. 13 and 14, the shaped body of the single-piece trip member 40 comprises only one through channel, e.g. the first through channel 45 pivotally mounted around the first pivot 112.

In particular, according to the embodiment of FIG. 14, the circuit breaker 100 can comprise a block 114 provided inside the casing 101 and suitable to interact with the second part **40*b* of the trip member 40 and cause the second part 40*b* to deform towards the signaling device 10 with the third portion 43 actuating the signaling device 10, e.g. by actuating the lever 11**.

In the examples illustrated in the figures, the retaining means 46 are provided at the first through channel 45 and are structured to mechanically retain the movable trip member 40 coupled to the pivot 112, while allowing its movement relative thereto when the movable trip member 40 is actuated during a tripping operation and during a circuit breaker resetting operation as will be described hereinafter.

In the example illustrated, the retaining means 46 comprises a plurality of teeth, e.g. four, shown only in FIG. 2 for the sake of clarity of illustration.

Clearly, it is possible to provide retaining means 46 at the second through hole 51 when present, in addition or in alternative to the retaining means 46 provided at the first through channel 45.

Preferably, the at least one portion elastically deformable comprises a first portion elastically deformable 44 which is provided on the second part 40*b*, and which structurally interconnects the third portion 43 with the first part 40*a*.

According to the exemplary embodiment illustrated in FIGS. 2-11, the first portion elastically deformable 44 comprises a first branch 44*a* structurally interconnecting the third portion 43 with the first part 40*a* and a second branch 44*b* structurally interconnecting the third portion 43 with the second through channel 51, thus allowing at the same time to have the needed deformation with a reduced mechanical resistance.

Clearly, the first portion elastically deformable 44 can have a different shape, as for instance illustrated in the example of FIG. 13.

In the alternative embodiment illustrated in FIG. 13, the second part 40*b* can comprise for example a substantially rigid rod which, when the single-piece trip member rotates about the pivot 112, follows the same direction of the first part 40*a* and actuates the signaling device 10, e.g. the lever 11.

Preferably, the shaped body of the movable trip member 40 comprises a second portion elastically deformable 47 which is suitable to interact and elastically deform under the action of a portion of the handle 102 or of a portion 103 actuated by the handle 102 during a resetting operation.

In practice, the first portion elastically deformable 44 and/or the second portion elastically deformable 47 behaves like structurally compliant elements.

In particular, in the embodiments illustrated, the first part 40*a* of the shaped body comprises a base section 48 along which there is provided the first through channel 45 interposed between the first and second portions 41 and 42, and a curvilinear section 49, protruding from the base section 48 and having a cam-like surface provided on a face opposite to that of the first and second portions 41, 42.

In the examples illustrated, the curvilinear section 49 comprises the second portion elastically deformable 47.

Figure 5:
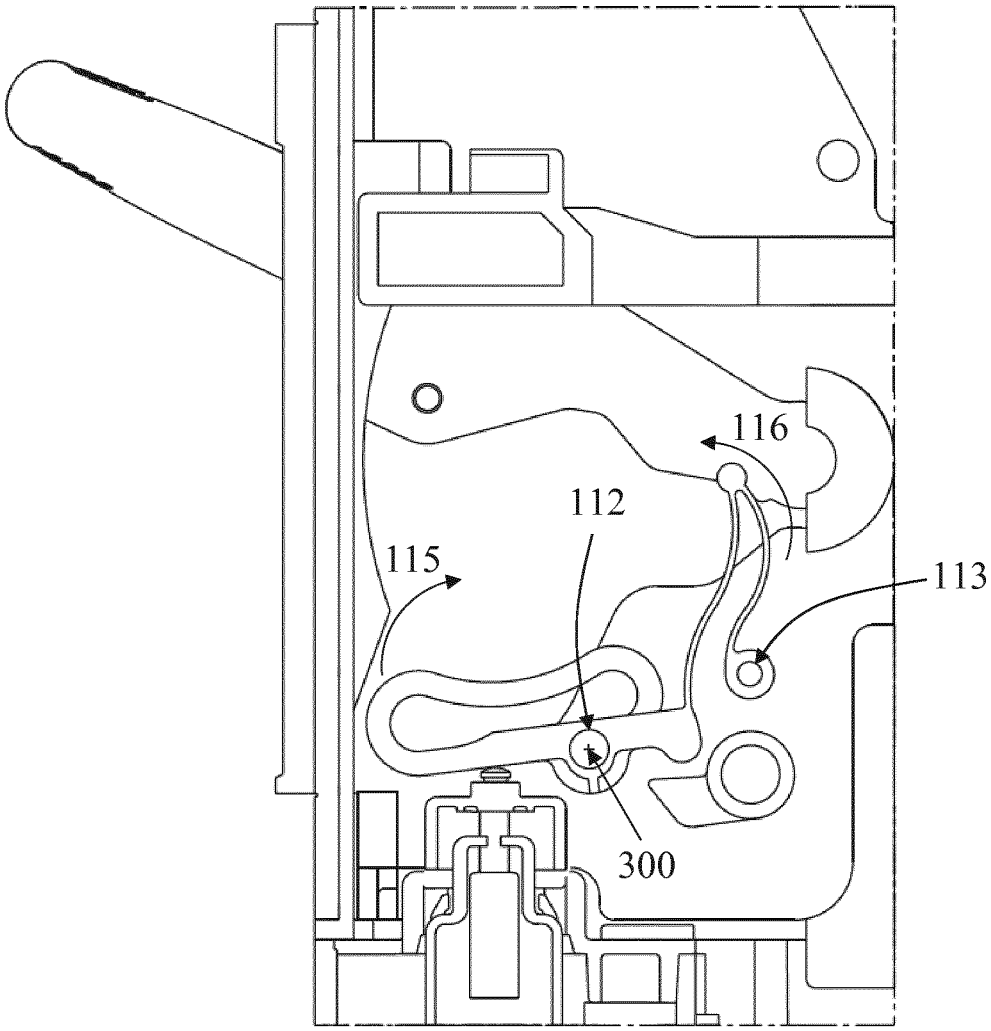
FIGS. 5-7 are schematic side views illustrating successive positions of some components of a circuit breaker according to the disclosure when switching from a closed status to a tripped status.

In practice, when the circuit breaker 100 is installed in operation and is in a closed status (see FIGS. 4, 15) if an electrical fault is detected, e.g. a short circuit, the actuator 3 is triggered and moves from its initial position impacting against the first surface 41 of the trip member 40 as shown in FIG. 5. As a consequence, the trip member 40 is actuated and starts moving with the first part 40*a* rotating around the axis 300 of the first pivot 112, e.g. in a clockwise direction schematically indicated in FIGS. 5-7 by the arrow 115; during this movement, the second portion 42 impacts against the first protuberance 32 (FIG. 6) and actuates the tripping bar 30 which starts rotating around its rotation axis 31.

Figure 6:
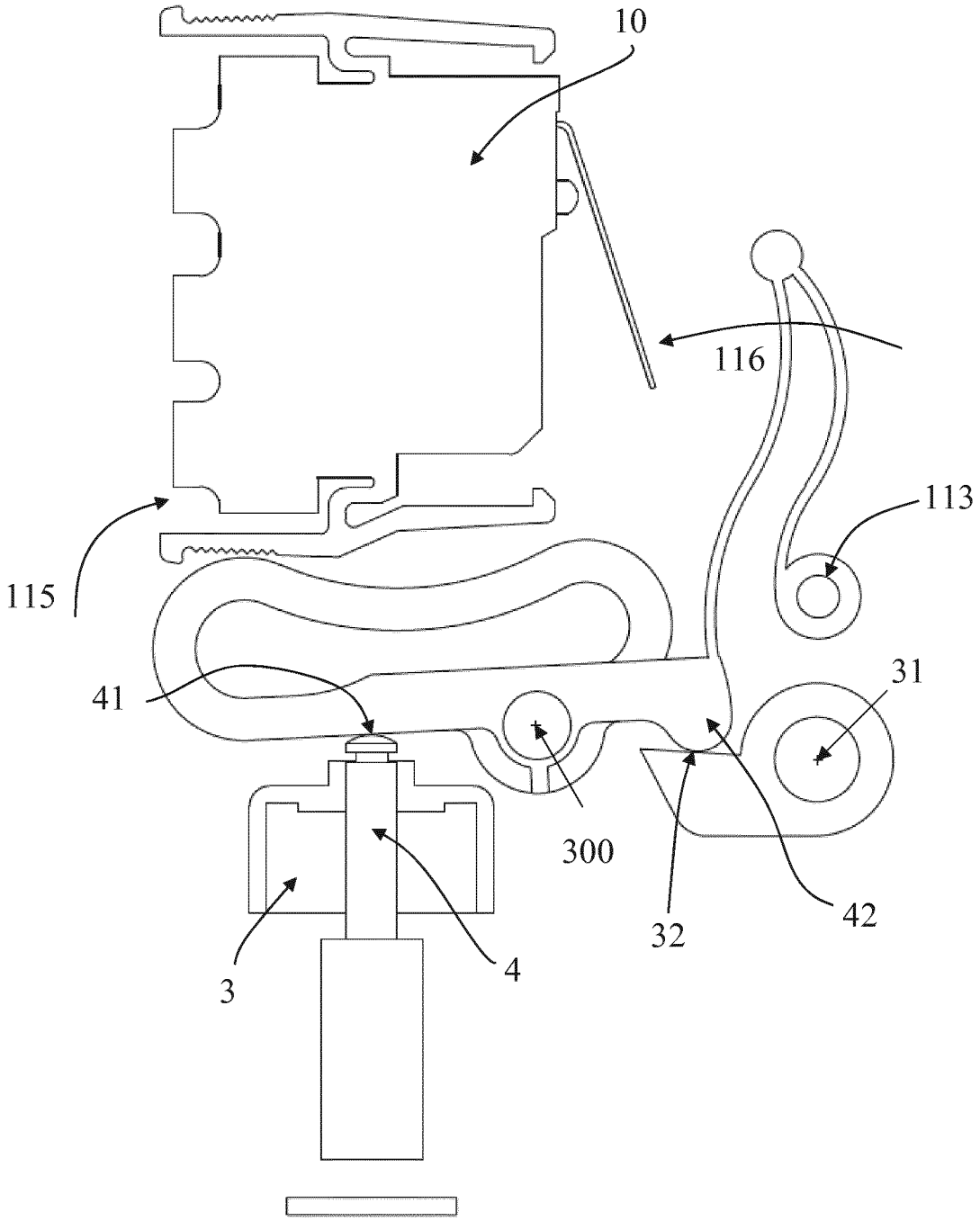

While the movement of the trip member 40 continues, also the second part 40*b* moves towards the opposite direction, schematically indicated in FIGS. 5-7 by the arrow 116.

According to the exemplary embodiments of FIGS. 1-12 during the tripping movement, while the first part 40*a* rotates clockwise around the first pivot 112, the second part 40*b* deforms and rotates counterclockwise around the second pivot 113.

In the example of FIG. 14, the block 114 causes the second portion 40*b*, and in particular the elastically deformable portion 44, to deform and bend towards the signal device 10 and in particular towards the lever 11.

In the embodiment of FIG. 13 instead, the second portion 40*b* rotates in the same direction, e.g. clockwise, with the first portion 114.

During its rotation around the rotation axis 31 the tripping bar 30 unleashes the lever 160, namely the protuberance 33 disengages from the corresponding portion 161, thus causing the protuberance 162 to disengage from the portion 151 thus causing the mechanism 200 to actuate the movable contact(s) 2 to separate from the corresponding fixed contact(s) 1; hence, the circuit breaker switches from the closed status to the tripped status illustrated in FIG. 16.

As illustrated in FIG. 7, the movable trip member 40 completes its movement reaching the actuated position with the third portion 43 actuating the lever 11 and thus the signaling device 10 which signals that the circuit breaker has reached the tripped status.

Figure 8:
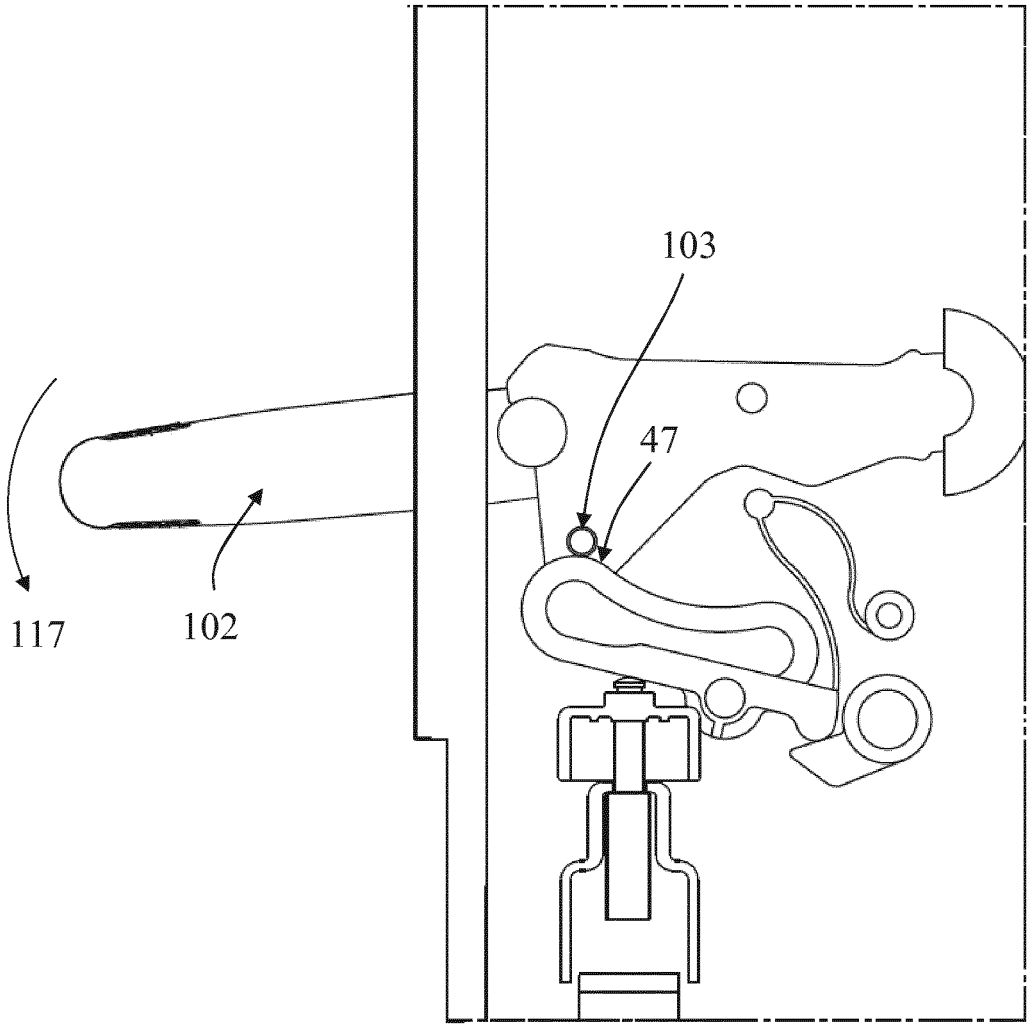
FIGS. 8-10 are schematic side views illustrating successive positions of some components of a circuit breaker according to the disclosure during a resetting maneuver from a circuit breaker tripped status.
Figure 9:
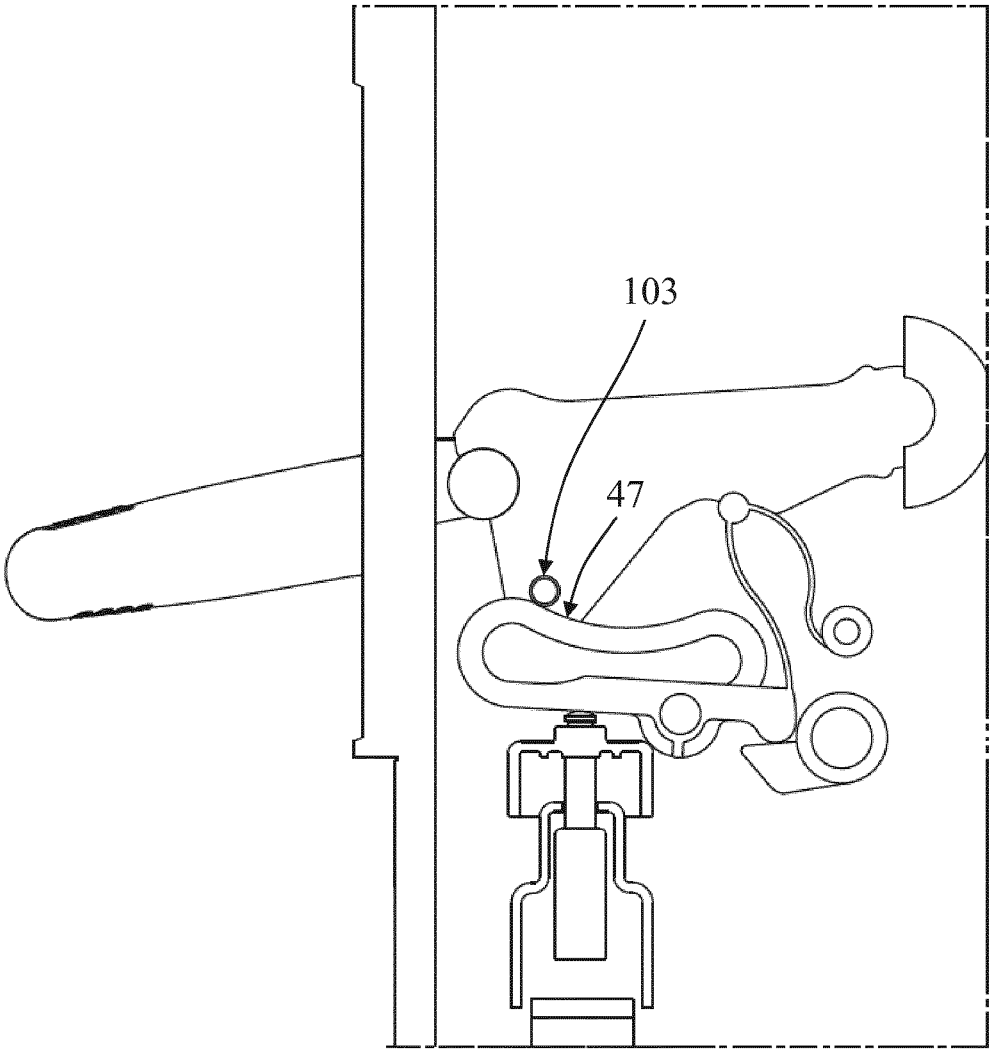

When the circuit breaker has to be reset, a user can intervene on the handle 102 which is for instance lowered down (arrow 117); in the example illustrated, the movement of the handle 102 brings a portion 103 associated therewith, e.g. a circular pin 103, to bear against the movable trip member 40, and in particular against its curvilinear surface 49, as illustrated in FIG. 8.

By continuing the downward movement (see for instance FIG. 9), the circular pin 103 moves along and bears against the curvilinear section 49, e.g. along its cam-like surface.

In this way, the movable trip member 40, through its first portion 31, pushes down the actuator 3 towards the initial position (see FIG. 10) and allows the tripping bar 30 to return in its initial un-tripped position, while the second part 40*b* elastically reassumes its initial shape and configuration thanks to the elastic return of the first deformable portion 44.

Figure 10:
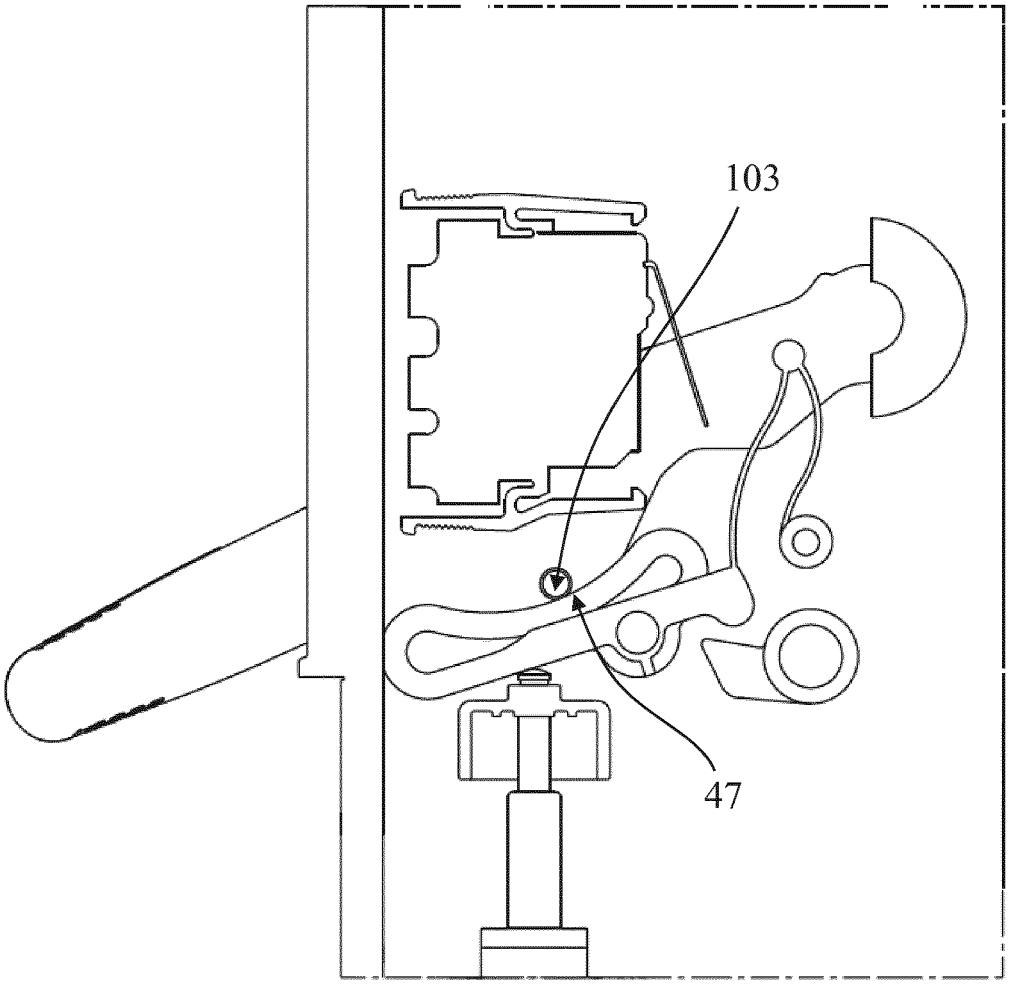

Advantageously, and as shown in FIG. 10, any extra stroke of the handle 102 during its downward movement is absorbed by the deformation of the elastically deformable portion 47 provided along the curvilinear section 49.

Figure 3:
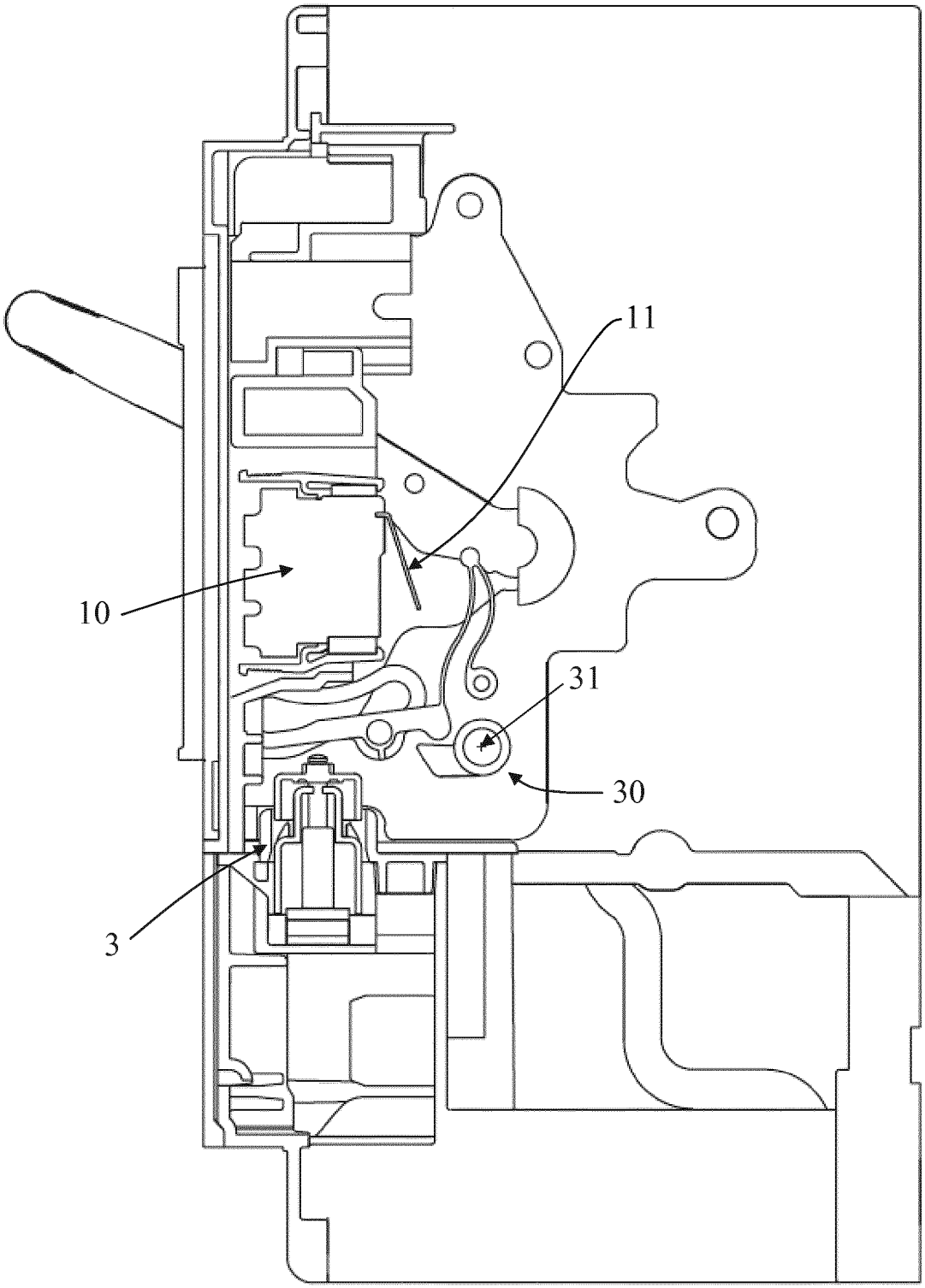
FIG. 3 is a schematic side view showing a circuit breaker in a closed status.

After the handle 102 has reached its lowest down position, it is thereafter raised up in its initial position shown in FIGS. 3-4 and the elastically deformable portion 47 reassumes its initial shape and configuration, with the whole trip member 40 returning to its initial rest position.

During the resetting operation, the movable contact(s) 2 is/are brought first in the circuit breaker open status (FIG. 17) and after into the circuit breaker closed status illustrated in FIG. 15; the same occur to the whole actuating mechanism 200.

In practice, it has been found that the circuit breaker 100 according to the present disclosure gives some improvements over known prior art according to a solution structurally simple and functionally effective; in particular, the movable trip member 40 integrates in its monolithic piece functions that in known solutions are performed by several distinct components. This allows simplifying the entire constructive architecture of the tripping mechanism, to ease mounting, and to substantially reduce the risk of undesired mechanical stuck or jamming.

Further, thanks to its overall structure, the movable trip member 40 remains still in its rest position without the need of additional retaining springs, and is able to absorb vibrations while keeping the distances D1 and D2 at the desired values, which values can be tailored according to the applications.

The circuit breaker 100 thus conceived is susceptible of modifications and variations, all of which are within the scope of the inventive concept as defined by the appended claims, including any combination of the above described embodiments which have to be considered as encompassed by the above description; all details may further be replaced with other technically equivalent elements. For example, the shaped-body of the movable trip member 40 and/or any of its part, e.g. the retaining means 46, as well as the shape and/or positioning of any of the portion, 41, 42, and 43, can be different provided they are suitable for the scope they were conceived; the through holes 45, 51 can be differently shaped, e.g. can be replaced by dead recesses; the trip bar 30 can interact directly with the second lever 150, or any of its part, e.g. the protuberance 33, can be differently shaped or positioned, provided also in this case that they are suitable for the scope conceived for; et cetera.

In practice, the materials, so long as they are compatible with the specific use, as well as the individual components, may be any according to the requirements and the state of the art.

The invention claimed is:

1. A circuit breaker comprising:

at least a first fixed contact and a first movable contact which can be switched between at least a circuit breaker closed status where the fixed and movable contacts are coupled to each other, and a circuit breaker tripped status where the fixed and movable contacts are separated from each other;

a signaling device suitable to be actuated in order to signal when the circuit breaker is in a tripped status;

a trip actuator suitable to move from an initial position to an end-stroke position when said at least first movable contact has to be switched from said circuit breaker closed status into said circuit breaker tripped status; and a tripping bar which is operatively connected to said first movable contact so as when said trip actuator moves from said initial position, said tripping bar moves from an un-tripped position towards a tripped position to trigger switching of said first movable contact from said circuit breaker closed status into said circuit breaker tripped status; and a movable trip member movable between a rest position and an actuated position, said movable trip member having a single-piece shaped body which comprises a first portion suitable to interact with and be actuated by said trip actuator to move from said rest position towards said actuated position when the trip actuator moves from said initial position towards said end-stroke position, a second portion which is spaced apart from said first portion and is suitable to interact and actuate said tripping bar to move from said un-tripped position towards said tripped position, and a third portion which is spaced apart from said first and second portions and is suitable to interact with and actuate said signaling device.

2. The circuit breaker according to claim 1, wherein said first, second and third portions are spaced apart from each other so as said second portion interacts with and actuates said tripping bar after said first portion interacts with said trip actuator, and said third portion interacts with and actuates said signaling device after said second portion interacts with and actuates said tripping bar.

3. The circuit breaker according to claim 2, wherein said movable trip member further comprises at least one elastically deformable portion.

4. The circuit breaker according to claim 3, wherein said movable trip member comprises at least one mounting seat which is mounted around an associated pivot provided inside the circuit breaker.

5. The circuit breaker according to claim 4, wherein said movable trip member comprises at least first retaining means which are structurally integral with the single-piece shaped body and are provided at least at said at least mounting seat, said first retaining means mechanically retaining the movable trip member coupled to said associated pivot.

6. The circuit breaker according to claim 5, wherein said movable trip member comprises a first part on which there are provided said first and second portions, and a second part on which there is provided said third portion, a shaped body of said movable trip member being structured so that said first part and said second part move in opposite directions with respect to each other.

7. The circuit breaker according to claim 3, wherein said movable trip member comprises at least one mounting seat which is mounted around an associated pivot provided inside the circuit breaker; and wherein said movable trip member comprises at least first retaining means which are structurally integral with the single-piece shaped body and are provided at least at said at least mounting seat, said first retaining means mechanically retaining the movable trip member coupled to said associated pivot.

8. The circuit breaker according to claim 1, wherein said movable trip member comprises a first part on which there are provided said first and second portions, and a second part on which there is provided said third portion, a shaped body of said movable trip member being structured so that said first part and said second part move in opposite directions with respect to each other.

9. The circuit breaker according to claim 8, wherein said at least one mounting seat comprises a first through channel which is provided on said first part and is pivotally mounted around a first pivot provided inside the circuit breaker, and wherein said first part rotates around a first rotation axis of said first pivot when moving from said rest position towards said actuated position, and is still in said rest position with said first and second portions at a corresponding predetermined distance from said trip actuator and said tripping bar, respectively.

10. The circuit breaker according to claim 9, wherein said at least one mounting seat comprises a second through channel which is pivotally mounted around a second pivot provided inside the circuit breaker.

11. The circuit breaker according to claim 10, wherein said second through channel is provided on said second part and comprises a slot-shaped cross-section.

12. The circuit breaker according to claim 10, wherein it comprises a first portion elastically deformable which is provided on said second part and structurally interconnects said third portion with said first part; and wherein said first portion elastically deformable comprises a first branch structurally interconnecting said third portion with said first part and a second branch structurally interconnecting said third portion with said second through channel.

13. The circuit breaker according to claim 9, wherein said first part comprises a base section along which there is provided said first through channel interposed between said first and second portions, and a curvilinear section provided on a face opposite to that of the first and second portions.

14. The circuit breaker according to claim 13, wherein said curvilinear section comprises said second portion elastically deformable.

15. The circuit breaker according to claim 8, wherein it comprises a first portion elastically deformable which is provided on said second part and structurally interconnects said third portion with said first part.

16. The circuit breaker according to claim 8, wherein it comprises a block positioned inside said circuit breaker and suitable to interact with said second part and cause said third portion to deform towards to and actuate said signaling device when the movable trip member moves from the rest position towards the actuated position.

17. The circuit breaker according to claim 1, wherein it comprises a handle, and wherein said movable trip member comprises a second portion elastically deformable suitable to interact and elastically deform under an action of a portion of said handle or of a portion actuated by said handle.

18. The circuit breaker according to claim 1, wherein said movable trip member comprises at least one mounting seat which is mounted around an associated pivot provided inside the circuit breaker.

19. The circuit breaker according to claim 1, wherein said at least one mounting seat comprises a second through channel which is pivotally mounted around a second pivot provided inside the circuit breaker.

* * * * *